United States Patent [19]

Wirth

[11] Patent Number: 4,703,976

[45] Date of Patent: Nov. 3, 1987

[54] SEAT

[75] Inventor: Heinz Wirth, Aalen-Oberalfingen, Fed. Rep. of Germany

[73] Assignee: Eisen- und Drahtwerk Erlau Aktiengesellschaft, Aachen, Fed. Rep. of Germany

[21] Appl. No.: 831,008

[22] Filed: Feb. 19, 1986

[30] Foreign Application Priority Data

Feb. 19, 1985 [DE] Fed. Rep. of Germany ... 8504604[U]

[51] Int. Cl.[4] ..... A47C 1/12

[52] U.S. Cl. ..... 297/445; 297/232; 297/440

[58] Field of Search ..... 297/443, 440, 445, 232

[56] References Cited

U.S. PATENT DOCUMENTS

| | | | |
|---|---|---|---|
| 2,976,122 | 4/1961 | Knoll | 297/445 |
| 3,503,933 | 4/1950 | Breuer | 297/445 X |
| 3,820,845 | 6/1974 | Persson | 297/445 |
| 4,209,198 | 6/1980 | Apple, Sr. | 297/443 |
| 4,299,423 | 11/1981 | Saiger | 297/440 |
| 4,426,114 | 1/1984 | Kehl | 297/450 X |
| 4,580,834 | 4/1986 | Martinez | 297/443 X |

*Primary Examiner*—James T. McCall

*Attorney, Agent, or Firm*—Becker & Becker, Inc.

[57] ABSTRACT

The seat consists essentially of a seat frame and a back rest frame, which are screwed to each other by way of plates which are welded thereto. The seat frame and back rest frame each consist of a curved sectional member, whereof the ends are constructed as skid-type feet. The seat frame and back rest frame are each strengthened by a transverse reinforcement and, when the surface of the seat or back rest includes a lattice, is welded to the frame, when the surface of the seat or back rest includes a plastic shell, it is attached to the frame by clamping.

14 Claims, 4 Drawing Figures

SEAT

BACKGROUND OF THE INVENTION

1. Field of the Invention

The invention relates to a seat having a seat frame with a seat part and a back rest frame with a back rest part.

2. Description of the Prior Art

Seats of this type are provided for distribution in parks, gardens, waiting rooms, and similar places. In according with this use, the seats must have a very stable construction and must also be weather-resistant. Therefore, a known seat of this type consists of two stable, closed, steel tubular frames, which form a seat frame and a back rest frame, and to which a lattice material is welded to serve as the seat surface or back rest. In a side view, the two frames are constructed with an approximate C-shape and at the opposing vertical frame parts are welded to one another by means of four cross-pieces.

A disadvantage with these known seats is that they project for quite a long way and are therefore also bulky, so that difficulties frequently arise, particularly regarding transportation and storage of these seats. They are also cost-intensive as a result of the spatial dimensions.

An object of the present invention therefore is to construct a seat of the abovementioned type so that it can be conveyed and stored in a manner which is as space-saving as possible.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
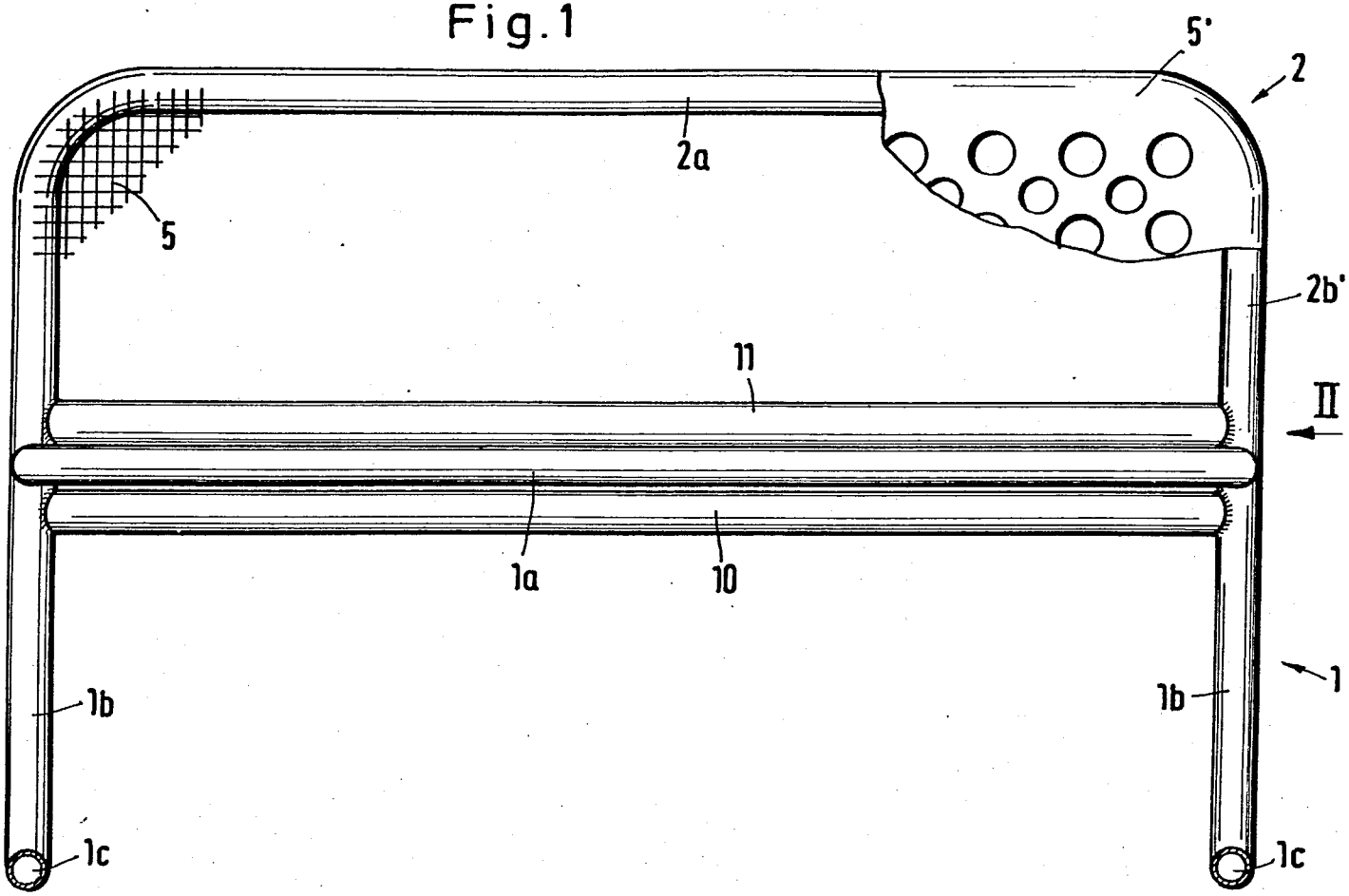
FIG. 1 is a front view of a bench according to the present invention.

The invention is characterized primarily in that the seat frame and the back rest frame each consist of a side-frame which is provided with legs, the free ends of which are at a distance apart from one another. Due to the advantageous construction of the seat frame and back rest frame, which are detachably connected to each other, the seat can be assembled or dismantled with few manipulations. Therefore, the space requirement, particularly when stacking several seats, is extremely low. Since the ends of the side-frames of the seat frame and back rest frame are constructed as free legs and not as a closed frame, both the seat frame, as well as the back rest frame, can be stacked offset laterally to one in another by the width of a tube, thereby providing an enormous saving of space. Also, when transporting only one seat, the back rest frame and seat frame can advantageously be fitted one within the other. In addition, because the bench is constructed with an open side frame, material is saved, approximately in the order of twice the length of the seat.

The assembly or dismantling of the seat is possible, even for a layman without special tools. This is due to the simple screw attachment which is made possible by means of the plates which are connected to the frame parts. The long ends of the side frames are constructed as skid-like feet and guarantee that the seat stands securely. Due to the advantageous incorporation of a cross member between the legs of the seat frame or back rest frame, high stability and resistance to torsion of the seat is achieved. This allows the building of even a long construction, for example as a bench, without additional strengthening.

According to a further advantageous construction of the invention, the seat part and back rest part may be constructed as plastic shells, which are attached by clamping in a simple manner between the frame parts. In this embodiment, the seat part and back rest part can be exchanged without the use of tools, for example, in the case of damage to these parts. It is also possible to remove these parts from permanently mounted seats, for example, for storage in the winter.

If the seat is to be arranged so that it cannot be moved, then the latter may also be anchored directly in a foundation without the need for great reconstruction. In this embodiment also, the advantageous stacking ability of the seat frame and back rest frame, one within the other, is in no way impaired.

As a result of the connection of the two frame parts by means of plates, which are screwed to each other, a simple and thus inexpensive, and at the same time reliable, connection of the two frame parts to each other is achieved.

DESCRIPTION OF THE PREFERRED EMBODIMENTS

Referring now to the drawings in detail, the seat illustrated in the drawings is a bench, on which several people can be seated side by side. The bench consists essentially of a seat frame 1 and a back rest frame 2, which are screwed or bolted to each other by means of plates or pieces 4. In this embodiment, the two frame parts 1 and 2 each consist of a tube or pipe, which is bent to form a side frame 1 having two legs **1*b*, 2*b*, whereof the free ends 1*c*, 2*c* are arranged at a distance apart from one another. As illustrated in the front view according to FIG. 1, the side frame which forms the seat frame 1 has a front transverse tube 1*a*, which extends over the entire length of the bench. At its ends, the side frame is bent back through 90° so that the free legs 1*b'* extend approximately horizontally towards the back rest frame 2. Shortly before the free legs 1*b'* reach the back rest frame 2, the latter are bent approximately vertically downwards and extend virtually to the floor, where they are bent forwards through approximately 90°, so that the free ends 1*c* of the side-frame form runner- or skid-like feet extending parallel to the surface on which the seat stands. Provided on the approximately vertical parts of the legs 1*b* of the seat frame 1 which extend towards the ground are two plates 4 arranged at a distance one above the other. These plates 4 overlap counter-plates 4*a*, which are provided on the back rest frame 2**, and are screwed to the latter.

Figure 2:
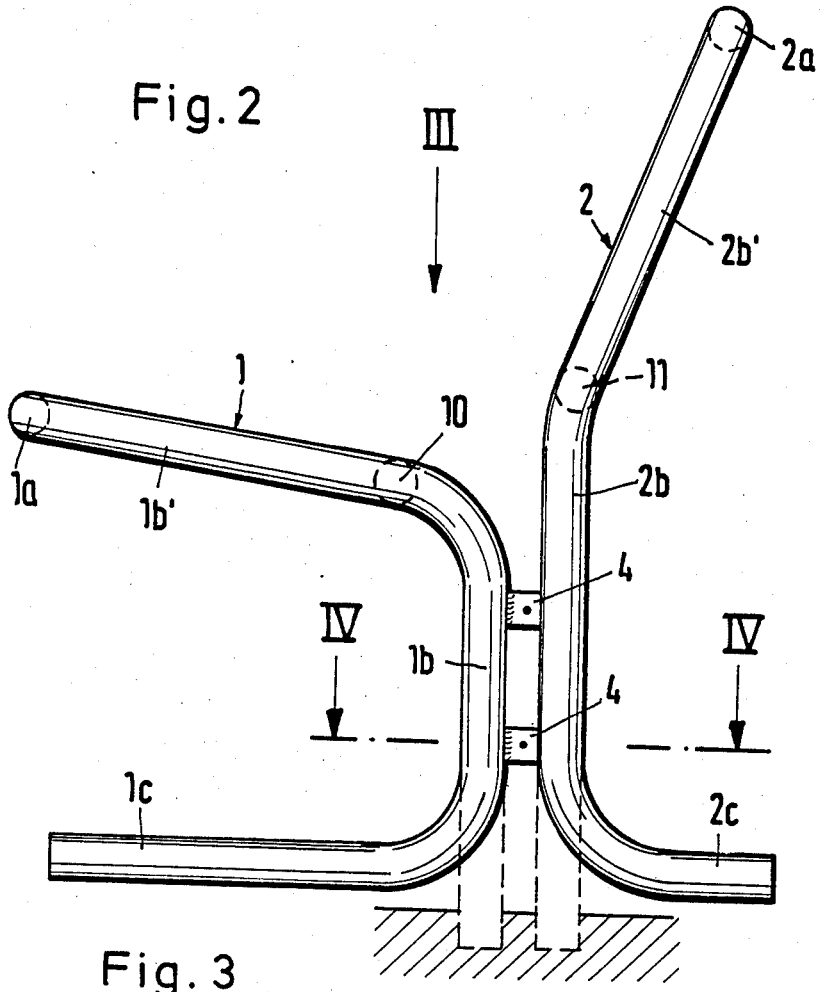
FIG. 2 is a side view taken in the direction of arrow II of FIG. 1.

The back rest frame 2 likewise consists of a tube, which is bent to form a side-frame. The back rest frame or side-frame 2 has an upper transverse tube **2*a*, which likewise extends over the entire length of the bench and which closes off the back rest at the top (FIG. 1). At the sides, the transverse tube 2*a* is bent through approximately 90°, with the legs 2b' extending in a straight line downwards and towards the front. At approximately the height of the front transverse tube 1a, the legs 2b of the back rest frame 2 are bent slightly forward and from there, they extend vertically downwards almost to the ground, where they are bent rearward through a 90° angle. The free ends 2c of the back rest frame 2 thereby form skid-like feet 2c, which are directed rearwardly and extend parallel to the surface on which the seat stands (FIG. 2). In order to ensure that the seat stands securely and to prevent the bench from tilting backwards, the free ends 2c extend beyond the plumb line of the upper transverse tube 2a. The counter-plates 4a are welded to the vertical parts of the legs 2b. The counter-plates 4a are located at the same height as the opposing plates 4**.

Figure 3:
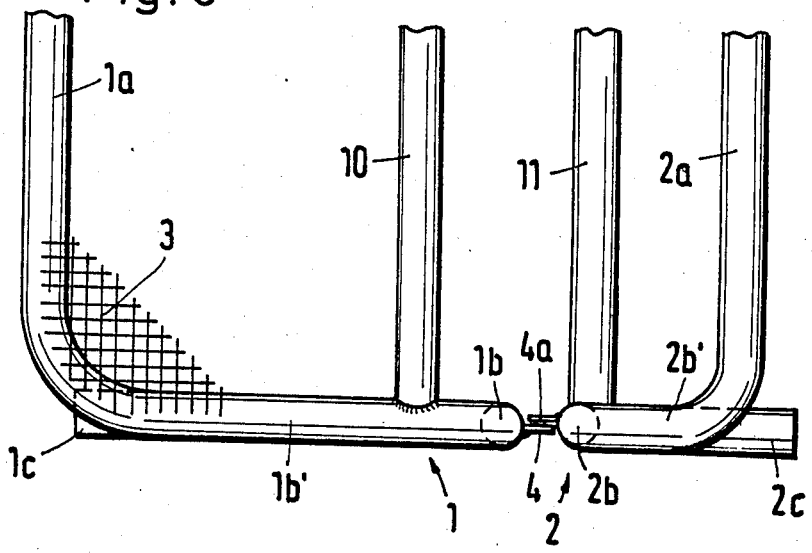
FIG. 3 shows part of a plan view taken in the direction of arrow III of FIG. 2.

As shown in FIGS. 1 to 3, a cross-member 10 or 11, respectively, is provided both in the seat frame 1 and in the back rest frame 2. This member 10 or 11 extends over the entire length of the seat between the legs 1b, 2b and serves to strengthen the frames 1 and 2. The cross-members 10 and 11 likewise consist of a tube or pipe, and are welded at their ends to the seat frame 1 and back rest frame 2. The cross-members also serve to connect the legs 1b, 2b. The diameter of the cross-members 10 and 11 may be smaller than that of the side-frames 1 and 2. The cross-member 10 is located approximately where the leg 1b' of the side frame 1, which is directed rearwardly, passes into a part which is bent downwardly. This is particularly advantageous since, as a result of this, the rear side of the seat part 3 has an additional support. The seat part 3, which in this embodiment is constructed as lattice work, rests at its front side on the cross member 1a, at the two narrow sides on the legs 1b' which are directed rearwardly. At its rear side, the seat part 3 rests on the cross-member 10 and is welded on all four sides. The cross-member 11 is welded between the legs 2b of the back rest frame 2 at the point where the part of the legs 2b' which is directed forward and downward passes into the part 2b which is directed vertically downwardly. The cross-members 11 form the lower boundary of the back rest part 5. As illustrated on the left in FIG. 1, a lattice structure is provided as the back rest part 5, and is welded to the cross member 2a, the parts of the sides or legs 2b' being directed forward and downward and to the cross-member 11. The welding of the lattice work 3, 5 to the tubes 1, 2, 10, 11 can be carried out in a particularly economical manner by resistance spot welding; the stability of the frames 1 and 2 is additionally increased by this. In place of the seat or back rest parts 3 and 5 which are constructed as a lattice, plastic shells 5', or other plastic surfaces can be used. These are preferably anchored to the frame by a simple clamping procedure, as illustrated, for example, in FIG. 1 on the top right (see back rest part 5').

In the embodiment which is shown in FIG. 2, the seat surface 3 is inclined slightly rearwards, and the back rest 5 is inclined rearwards somewhat more. This arrangement allows a particularly relaxed sitting and has proved to be extraordinarily comfortable. Preferably, the seat surface is tilted rearwards by approximately 8°, whereas the back rest encloses an angle of approximately 23° with the vertical. This results in an angle of 115°, which is formed or enclosed by the seat surface and back rest.

The tubes used in this embodiment for the seat frame 1 and back rest frame 2 have a diameter of approximately 40 mm, in which case the radii of bending of the tubes amount to approximately 80 mm. As a result of this, a very solid and torsion-resistant construction is advantageously obtained. In addition, the relatively strong tubes, in particular the front cross-tube 1a, ensures that even people with relatively short legs may sit comfortably, without the cross-tube 1a cutting into the bend of the knee or pressing against it uncomfortably. Even in the region of the feet 1c, 2c, a relatively large tube diameter is advantageous, since this results in an increase of the support surface of the bench. This is a particular advantage when placing the seat on lawns or similar areas, since the feet are prevented from sinking into the ground or support area.

Figure 4:
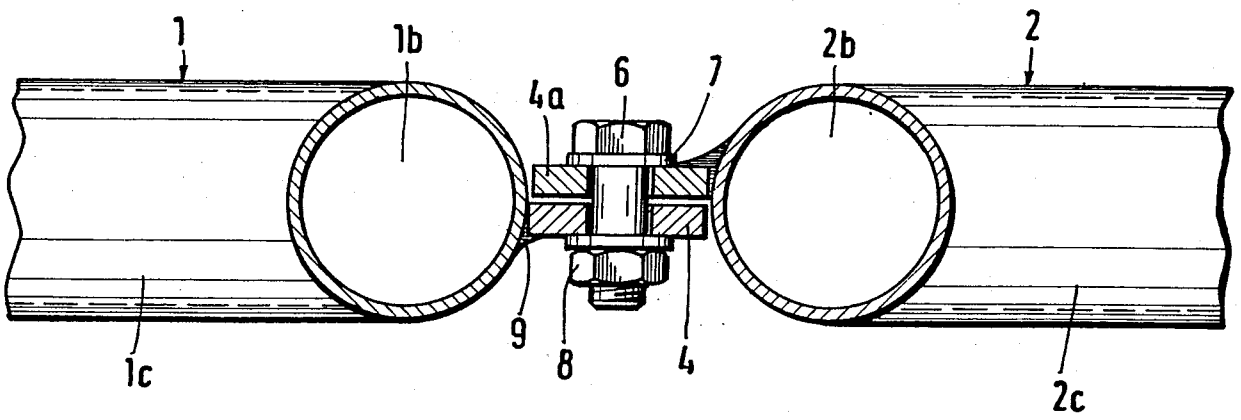
FIG. 4 shows, on an enlarged scale, part of a section taken along line IV—IV of FIG. 2.

In this embodiment, seat frames 1 and back rest frames 2 are each provided with four plates 4, 4a, which are made from flat material. The plates 4, 4a have an approximately square shape in side view (see FIG. 2) and overlap each other almost completely. The plates are each welded at one side with a single fillet-weld to the side-frame 1 or 2. Butt welding on only one side respectively is very advantageous, since as a result of this the length of overlap of the plates 4, 4a and thus the stability of the bench is increased. At the same time, one welding operation is dispensed with due to this. As shown in the sectional view according to FIG. 4, the plate 4 and counter-plate 4a each have a bore, which are in alignment with each other and through which a bolt 6 is guided. Seated at the end of the bolt 6 is a nut 8, by means of which the plate 4 and counter-plate 4a are braced with respect to each other. The screw connection is secured in a known manner against accidental release by means of washers 7 (or retaining rings or self-locking nuts). As shown in FIG. 3 and 4, the head of the bolt and nut 8 are very easily accessible, so that the bench can be dismantled or assembled within the shortest possible time. The dismantled bench, which consists of the seat frame 1 and back rest frame 2, can be conveyed and stored in an essentially space-saving manner. When storing or transporting several benches, the seat frames 1 and back rest frames 2 may very advantageously be stacked one within the other, so that only a relatively small space is required.

The screw connection between the plates 4 and counter-plates 4a is particularly favorable in this case since this allows their assembly or dismantling to be accomplished in the shortest possible time, by unskilled persons, and without special tools being required.

The aforedescribed bench has a particularly stable position, since the free ends 1c, 2c jut out a relatively long distance. In particular, this prevents the bench from tilting rearwards and forwards. In order to avoid corrosion, all parts, with the exception of the bolt 6, are covered with a plastic coating or lacquer, and the ends of the tubes are provided with plastic caps.

According to a further embodiment, the bench may also be assembled in a stationary manner, in that the vertical parts of the legs 1b, 2b are guided into a foundation which is provided in the ground. In this case the feet 1c and 2c that are constructed as skids can be dispensed with. Depending on the thickness of the tubes 1 and 2, it may be adequate to anchor only the tubes of the seat frame 1 or of the back rest frame 2 in the foundations. With a construction of this type, the non-supporting parts of the legs 1b, 2b terminate below the lower plates 4, 4a. In this case the bench can thus either be concreted securely in place in a known manner or guided by means of a sleeve or casing in a removable manner.

According to the present invention, the seat described by means of these embodiments may also be constructed as a chair, i.e. seating one person, as a bench capable of seating several persons, or as a curved bench composed of segments, as is usual in seats of this type. If the seat has a short length, for example, as a seat for one person or as a corner unit, it is possible to dispense with the cross members 10, 11. In the case of benches, which are composed of several segments, plates may also be provided laterally on the vertical parts of the legs 1*b*, 2*b*, by means of which the adjacent segments may be connected. The aforedescribed construction of the frame parts 1 and 2 from circular tubes is very advantageous, but not absolutely necessary. A construction using other forms or sectional members is possible.

The seat is very strong, hard-wearing, and is largely immune to the effects of weather in the aforedescribed constructions. Assembly or dismantling is carried out in a short time using only four bolts, so that when the seat is not in use, for example in winter, it is possible to dismantle the seat frame and back rest frame and to stack them individually. This results in the savings of a storage space. Also handling, particularly in the case of large benches, is considerably facilitated.

It should also be mentioned that the seat frame 1 is a self-supporting construction, which if necessary may also be set up without the back rest part.

The present invention is, of course, in no way restricted to the specific disclosure of the specification and drawings, but also encompasses any modifications within the scope of the appended claims.

What I claim is:

1. A seat which is provided with a seat part and a back rest part and which comprises:

a seat element which includes at least one first side portion which is formed by a leg, said leg having a first end and a second end, with said second end of said leg being a free end, said seat element being formed as a tube support bent to include a horizontally extending front transverse tube which at both ends thereof is bent into portions including a transition into downwardly projecting legs which in turn change into free ends which extend forwardly, said transverse tube, legs and free ends forming said tube support unitarily therewith; and a back rest element which includes at least one second side portion which is formed by a leg, said leg having a first end and a second end, with said second end of said leg being a free end, said back rest element being formed as a further tube support bent to include a horizontally extending upper transverse tube which at both ends thereof is bent into portions including downwardly projecting legs which in turn change into free ends that extend rearwardly counter to the free ends that end forwardly, said upper transverse tube, legs and free ends forming said further tube support unitarily therewith, and with said free ends of said legs of said first and said second side elements being spaced at a distance apart from one another, and, further, with said first side portion of said seat element being detachably connected to said second side frame of said back rest frame via overlapping plates and fastener means to connect said plates to each other.

2. A seat according to claim 1, in which said legs of said first and said second side portions are positioned adjacent to and opposite from one another, with each of said legs of said first and said second side portions being provided with plates which effect a connection between said first side portion and said second side portions.

3. A seat according to claim 1, in which leg of said first side portion of said seat element is bent to form an approximate U-shape, with said free end of said leg being bent in a forward direction away from a point of detachable connection to said back rest element to form a forwardly directed foot which extends parallel to the surface upon which said seat stands.

4. A seat according to claim 1, in which said leg of said second side portion of said back rest element is bent to form a curved-like shape, with said free end of said leg being bent in a rearward direction away from a point of detachable connection to said seat element to form a rearwardly directed foot which extends parallel to the surface upon which said seat stands.

5. A seat according to claim 4, in which one area of said seat part, preferably a rear area which lies closest to said point of detachable connection between said seat element and said back rest element, said seat element is provided with a strengthening cross member which connects said U-shaped legs of said side portions of said seat element.

6. A seat according to claim 5, in which said back rest element is provided with a strengthening cross member which connects said curved-like legs of said side portions of said back rest element, with said cross member preferably being located on said back rest element in an area near its point of detachable connection to said seat element.

7. A seat according to claim 6, in which said seat part and said back rest part enclose an angle of approximately 115°, and with said seat part preferably being tilted backwards by an angle of approximately 8°.

8. A seat according to claim 7, in which said seat part and said back rest part preferably consist of a lattice work which is welded to said seat element, said back rest element, and said cross-member of said seat element.

9. A seat according to claim 7, in which said seat part and said back rest part preferably consist of plastic shells which are clamped to said seat element and said back rest element.

10. A seat according to claim 2, in which said free ends of said legs of said seat element extend vertically downward for fixing in a foundation.

11. A seat according to claim 2, in which said free ends of said legs of said back rest element extend vertically downward to allow said legs to be fixed in a foundation.

12. A seat according to claim 2, in which said plates are butt welded, and preferably with only one fillet weld to attach one said plate to said seat element and one said plate to said back rest element.

13. A seat according to claim 2, in which said plates consists of flat material and, viewed from the side, preferably form a rectangular shape.

14. A seat according to claim 2, in which in said position of said detachable connection between said seat element and said back rest element, said plates overlap one another almost completely, and in which each of said plates is provided with a bore, for receiving a fastening screw, with each of said bores being capable of being placed in alignment with one another.

* * * * *